US009190767B2

(12) United States Patent
Makimura

(10) Patent No.: US 9,190,767 B2
(45) Date of Patent: Nov. 17, 2015

(54) ELECTRICAL CONNECTION STRUCTURE BETWEEN MODULE DEVICE AND AN EXTERNAL DEVICE

(71) Applicant: SMK Corporation, Tokyo (JP)

(72) Inventor: Takanobu Makimura, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/089,949

(22) Filed: Nov. 26, 2013

(65) Prior Publication Data

US 2014/0148030 A1 May 29, 2014

(30) Foreign Application Priority Data

Nov. 29, 2012 (JP) ..... 2012-261610

(51) Int. Cl.
*H01R 13/52* (2006.01)

(52) U.S. Cl.
CPC ..... *H01R 13/5219* (2013.01); *H01R 13/52* (2013.01); *H01R 13/521* (2013.01); *H01R 2201/26* (2013.01)

(58) Field of Classification Search
CPC ..... H01R 13/521
USPC ..... 439/271, 278, 279, 283, 953, 308, 309, 439/310, 321, 322, 327, 345–347, 401, 407, 439/450, 144, 147, 153, 292, 299, 302, 366, 439/377, 587–595
See application file for complete search history.

(56) References Cited

U.S. PATENT DOCUMENTS

| | | | | |
|---|---|---|---|---|
| 4,705,339 | A * | 11/1987 | Hayes et al. | 439/277 |
| 6,821,160 | B2 * | 11/2004 | Fink et al. | 439/701 |
| 7,077,676 | B2 * | 7/2006 | Matsumoto et al. | 439/271 |
| 2011/0189888 | A1 * | 8/2011 | Rhein | 439/572 |
| 2012/0100752 | A1 * | 4/2012 | Ooki | 439/588 |

FOREIGN PATENT DOCUMENTS

JP 2008170801 A 7/2008

* cited by examiner

*Primary Examiner* — Abdullah Riyami
*Assistant Examiner* — Harshad Patel
(74) *Attorney, Agent, or Firm* — Locke Lord LLP

(57) ABSTRACT

An object is to provide an electrical connection structure between a module device and outside having high reliability of electrical connection and excellent assembling performance. There is provided the electrical connection structure of a module device, wherein a housing accommodating the module device has a mounting hole for mounting a cable connector electrically connected with an external device, a contact of the module device side is disposed inside a housing positioned in the mounting hole, the structure includes a terminal pressed and connected to the contact of the module device side, and a connector housing that accommodates and holds the terminal, the terminal is held in the connector housing so as to have airtight and watertight properties from a connection portion between the terminal and a core wire of a cable to a covering portion of the cable, and the cable connector and the housing are connected so as to have the watertight property.

4 Claims, 8 Drawing Sheets

(a)

(b)

(a)

(b)

(a)

(b)

(a)

(b)

ELECTRICAL CONNECTION STRUCTURE BETWEEN MODULE DEVICE AND AN EXTERNAL DEVICE

CROSS REFERENCE SECTION

This application claims priority under to Japanese patent application JP2012-261610 under 35 U.S.C. §119(a) filed on Nov. 29, 2012, which is incorporated by reference herein in its entirety.

BACKGROUND

1. Field of the Invention

The present invention generally relates to an electrical connector and more particularly, relates to a connection structure for electrically connecting a module device such as a camera with an external device such as a control device, power supply, and the like.

2. Description of Related Art

A module device such as a vehicle mounted camera is typically electrically connected to an external control device, power supply, etc. The electrical connection between the vehicle mounted camera and the external device is typically subjected to a variety of harsh environmental conditions, including but not limited to vibration as well as liquids (e.g., water). Despite efforts to date, designing an electrical connection that is both durable to withstand the environmental conditions and reliable to consistently provide a stable electrical connection is difficult. Thus, there remains a need in the art for a durable, reliable electrical connecter and further, there is a need for an easy to assemble electrical connector. An object of the present invention is to provide an electrical connection structure between a module device and an outside external device which has high reliability of electrical connection and excellent assembling performance.

SUMMARY

An electrical connection structure between the module device and the outside device according to the invention includes a mounting hole for mounting a cable connector electrically connected to an external device, the mounting hole formed in a module housing that accommodates a module device, a contact of the module device side is disposed inside module the housing located in the mounting hole, the structure has a terminal pressed and connected to the contact of the module device side, and a connector housing that accommodates and holds the terminal, the terminal is held in the connector housing so as to have airtight and watertight properties from the connection portion between the terminal and a core wire of the cable to a covering portion of the cable, and the cable connector and the housing are connected to each other so as to have watertight property.

According to the invention, the assembling performance is improved by providing the mounting hole of the cable connector allowed to directly pass through the housing, and moisture is prevented from entering the housing by ventilation or the like via the cable interior.

Although there are various methods in such a waterproof means, for example, the terminal can be accommodated in the connector housing in a state in which the core wire of the cable is connected to the rear portion of the terminal, and portions from the connection portion between the terminal and the core wire of the cable to the covering portion of the cable can be embedded in a sealant.

In this context, the sealant refers to a material having the waterproof property. The connection portion between the terminal and the cable core to the covering portion of the cable are enclosed by this sealant. Various methods can be employed in this case.

For example, there are some methods such as a method of placing portions from the connection portion between the terminal and the core wire to the covering portion of the cable into a mold, and injecting and curing an adhesive into the mold, a method of injecting and molding a hot-melt resin, a method using an RIM molding (polymerization reaction and curing are performed in the mold) and the like.

Furthermore, in this case, the sealant is connected to the cable using a cord bushing, and the cord bushing and the housing may be fixedly connected with the fixing member via a seal member.

In the invention, since the connection structure is adopted that brings the terminal provided in the cable connector into pressure-contact with the contact of the module device side, the assembling performance is excellent.

In general, a plurality of connection terminals is required in the case of the module device.

In order to easily secure flatness, parallelism, and pressing force of the terminals in such a case, a retainer for supporting the terminals from the rear may be disposed in the state of accommodating the terminal in the connector housing.

In the external electrical connection structure of the module device according to the invention, since it is possible to directly electrically connect the cable connector to the mounting substrate of the module device side, while securing the waterproof property, the number of assembly steps is less than the prior art, and the connection structure becomes more compact.

DETAILED DESCRIPTION

Description of Reference Numerals

Figure 1:
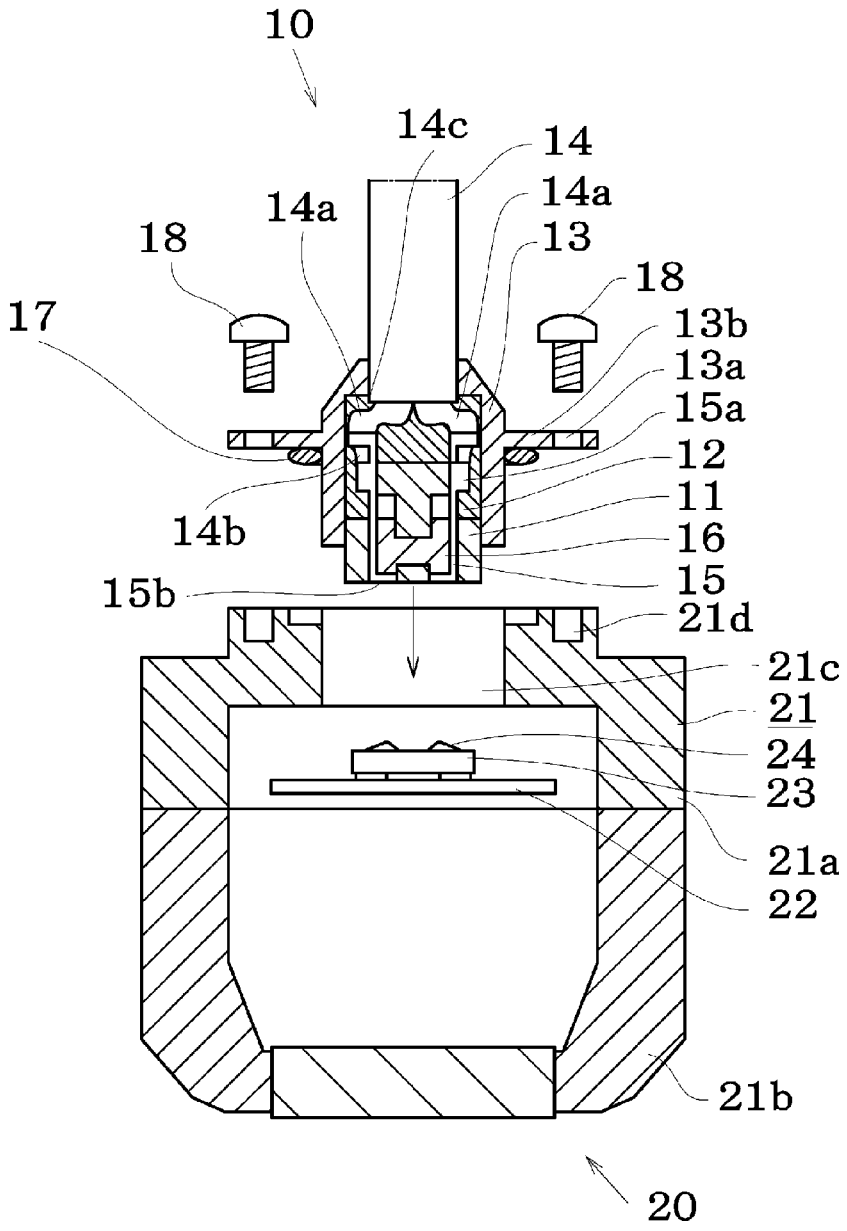
FIG. 1 illustrates an example of an electrical connection structure between a module device and the outside according to the present invention.

10 cable connector
11 connector housing

12 hot-melt molding body
13 cord bushing
14 cable
14*a* single line
14*b* core wire
15 terminal
16 retainer
17 seal member
18 fixing member
20 module device
21*a* rear case
21*b* front case
21*c* mounting hole
21*d* fixing hole
22 substrate
23 connector
24 contact As discussed above, when a module device such as a monitor camera device (which is mounted to a vehicle) is electrically connected to an external control device, a power supply or the like, the module device requires reliability of electrical connection capable of withstanding the vibration or the like during driving of the vehicle, and further may requires high waterproof property.

Figure 8:
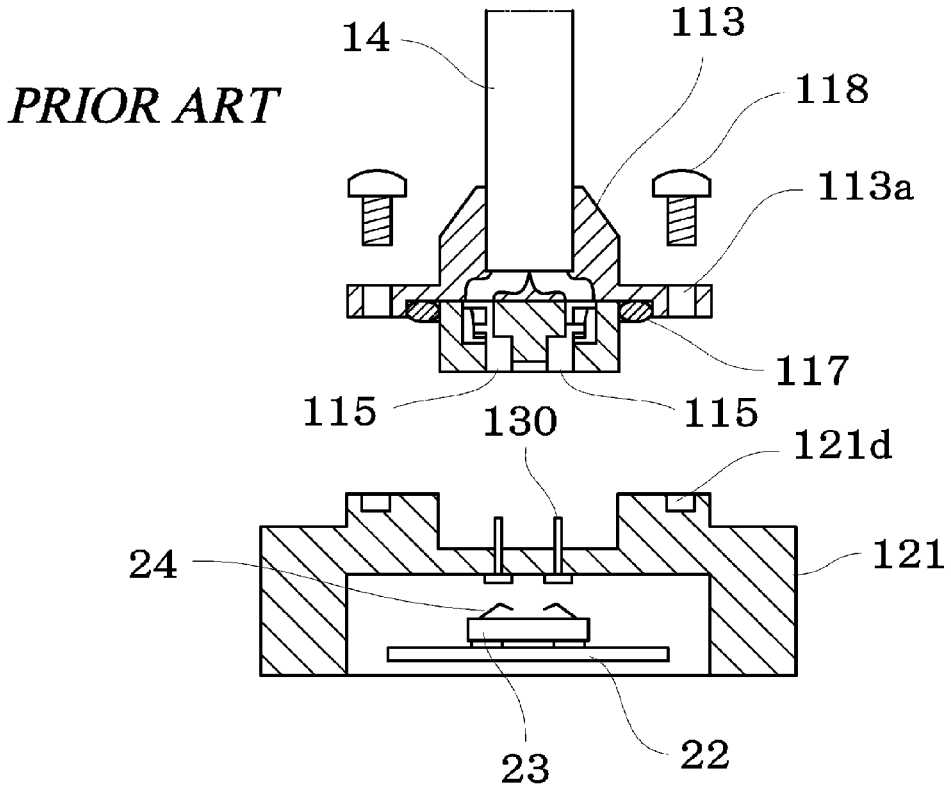
FIG. 8 illustrates an example of a conventional connection structure of the prior art.

For example, one conventional electrical connector—disclosed in JP 2008-170801 A—highlights one attempt to provide an electrical device for a module device that secures reliability of the electrical connection and has high waterproof property. Such electrical connector is shown in FIG. 8. Particularly, FIG. 8 schematically illustrates an electrical connection structure between the module device and the external device.

Referring to FIG. 8, there is provided a connector terminal 130 passing through a wall of a housing 121 that is equipped with a module device such as a monitor camera device in a watertight state, and an inner end portion of the connector terminal 130 is pressed and connected to an elastic contact 24 of a connector 23 implemented on a substrate 22 of the module device side.

Meanwhile, a socket terminal 115 of a connector 113 attached to a leading end of a cable 14 is electrically connected to the outside of the connector terminal 130 allowed to pass through the housing 121.

The connector 113 is screwed into a female screw portion 121*d* by the use of a fixing member 118 via a fixing hole 113*a* so as to insert a seal member 117 into the housing 121.

Although the electrical connection structure as disclosed in JP 2008-170801 A is compact and has high waterproof property, such an electrical connection structure requires a significant assembling work of electrically connecting a substrate of the electrical module device and the inside of the connector terminal provided by passing through the housing, and an assembling work of electrically connecting the cable connector to the outside of the connector terminal. Therefore, this requires an improvement in assembly performance and size reduction.

As discussed above, an object of the present invention is to provide an electrical connection structure between a module device and the outside which has high reliability of the electrical connection and excellent assembling performance.

Hereinafter, an example of an electrical connection structure according to the invention will be described with reference to the drawings.

Figure 2:
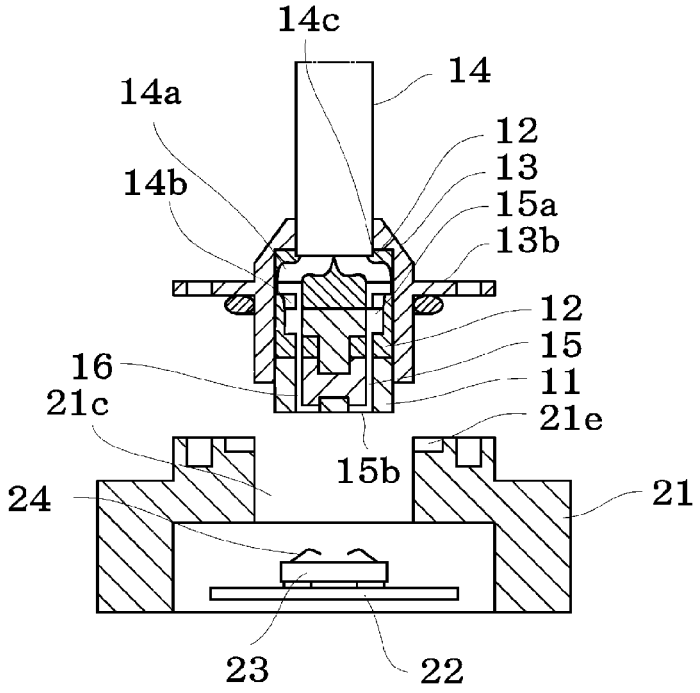
FIG. 2A illustrates a state before a cable connector is connected to the module device.
FIG. 2B illustrates a connection state.
Figure 2:
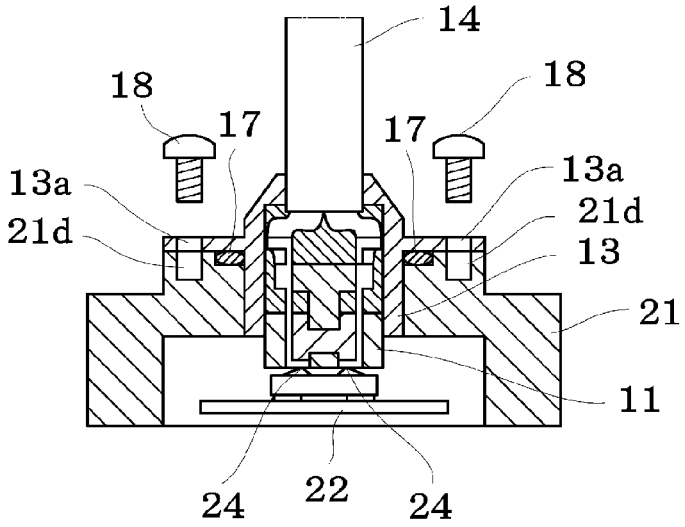

FIG. 1 illustrates a cross-sectional view, and FIG. 2 illustrates a connecting means. An embodiment illustrated in FIG. 1 is an example that connects a monitor camera device mounted on a vehicle to an external device via a cable.

This is an example in which a mounting hole 21*c* of a cable connector 10 is provided in a housing 21 equipped with a monitor camera as a module device 20.

FIG. 1 does not illustrate the monitor camera, and only represents a substrate 22, a connector 23 implemented on the substrate 22, and a contact 24 made of an elastic piece.

Since a mounting hole 21*c* is provided in the housing 21, in a state in which the monitor camera is built in the interior of a rear case 21*a* and a front case 21*b* constituting the housing 21, a portion between the rear case 21*a* and the front case 21*b* is first joined by welding or the like, and the monitor camera may be built in the housing.

The cable connector 10 has a connector housing 11, and a plurality of terminals 15 disposed inside the connector housing 11. The rear side of the terminal 15 is crimped to a core wire 14*b* of a single line 14*a* of a cable 14 by a crimping portion 15*a*, and portions from the crimping portion 15*a* to a covering end portion 14*c* of the cable 14 are embedded in a hot-melt molding body 12.

In addition, as long as the hot-melt molding body is a sealant having the waterproof property that is intended to prevent the ventilation (moisture penetration) via the interior of the cable 14, the hot-melt molding body is not limited to hot-melt resin.

A cord bushing 13 is molded by the insert molding so as to include a portion from an outer peripheral portion of the connector housing 11 to an outer peripheral portion of the hot-melt molding body 12.

Furthermore, when the terminal 15 is disposed inside the connector housing 11, a retainer 16 for supporting, from the back side, a terminal contact surface 15*b* formed by bending the leading end side of the terminal 15 substantially at a right angle.

FIGS. 1 and 2 schematically represent these structures in cross-sectional views. For example, FIG. 2A illustrates a state before a cable connector is connected to the module device, and FIG. 2B illustrates a connection state. Specific examples of the assembly procedure of the cable connector are further illustrated in FIGS. 4 to 7.

Figure 4:
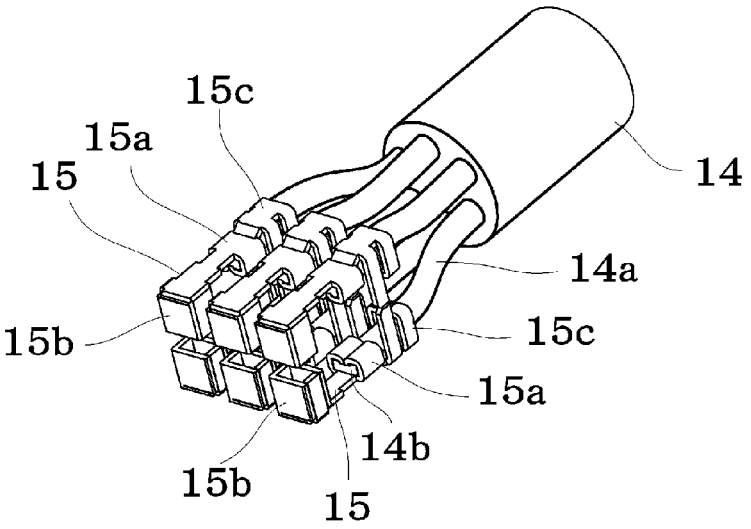
FIG. 4A illustrates a state in which a terminal is crimping-connected to each single line of a cable.
FIG. 4B illustrates a state in which the terminal is incorporated into a housing.
Figure 4:
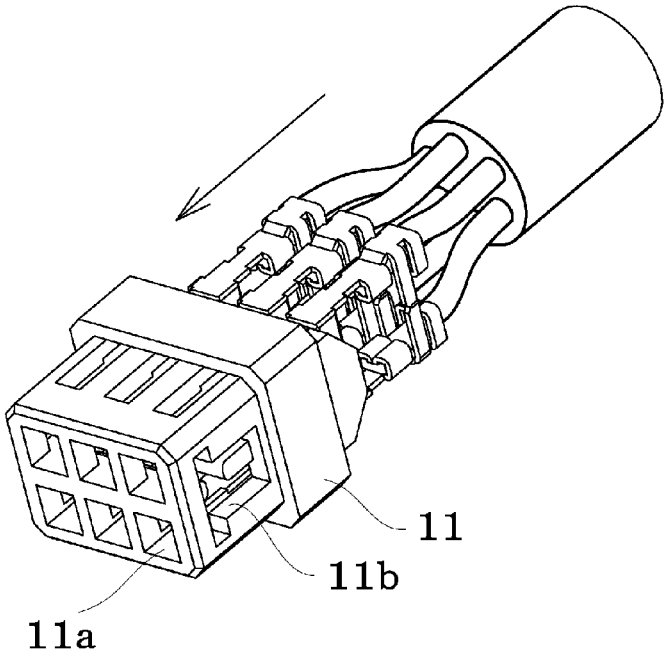

FIG. 4 illustrates an example of a 6P type in which six crimp terminals are crimped and connected to each single line 14*a* of the cable 14.

In addition, the invention is not limited to the 6P type. The terminal 15 has a caulking portion 15*c* caulked with the covering portion of the single line 14*a* of the cable, and a crimping portion 15*a* caulking-crimped to the core wire 14*b* of the single line on the rear side.

The leading end of the terminal 15 is formed with a terminal contact surface 15*b* coming into pressure-contact with the contact 24 made of an elastic piece of the module device side by being bent at a right angle.

In such a state, each terminal 15 is incorporated into the inside of the housing 11 from the back side of the housing 11, as illustrated in FIG. 4B.

Figure 7:
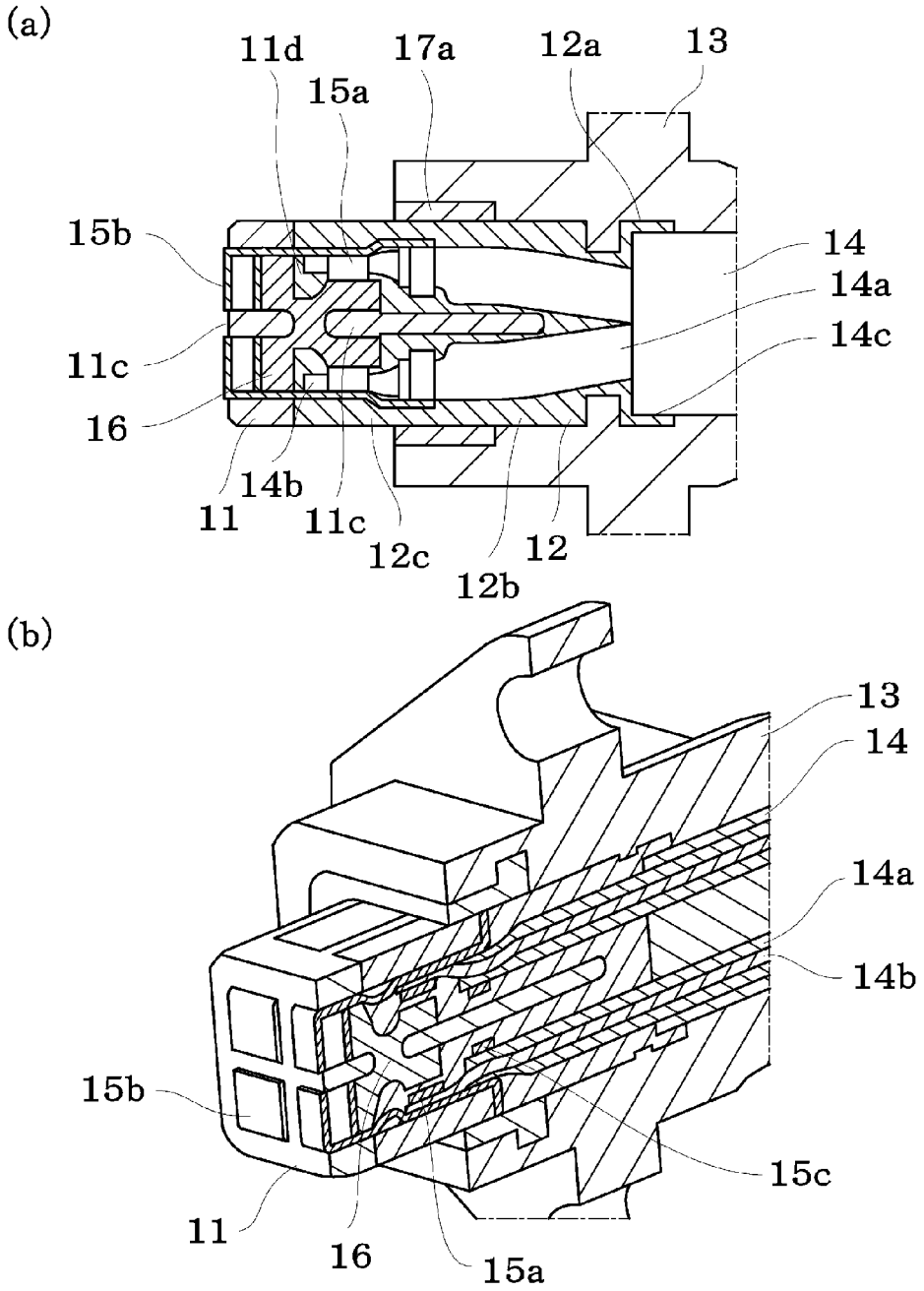
FIG. 7A illustrates a cross-sectional view of the cable connector.
FIG. 7B illustrates a cross-sectional perspective view thereof.

An example of the internal structure of the housing 11 is illustrated in FIG. 7.

The housing 11 has a terminal hole 11*a* through which the terminal contact surface 15*b* of each terminal 15 of 6P is inserted, and has a retainer insertion hole 11*b* for inserting the retainer 16 that supports the terminal contact surface 15*b* from the back side.

Figure 5:
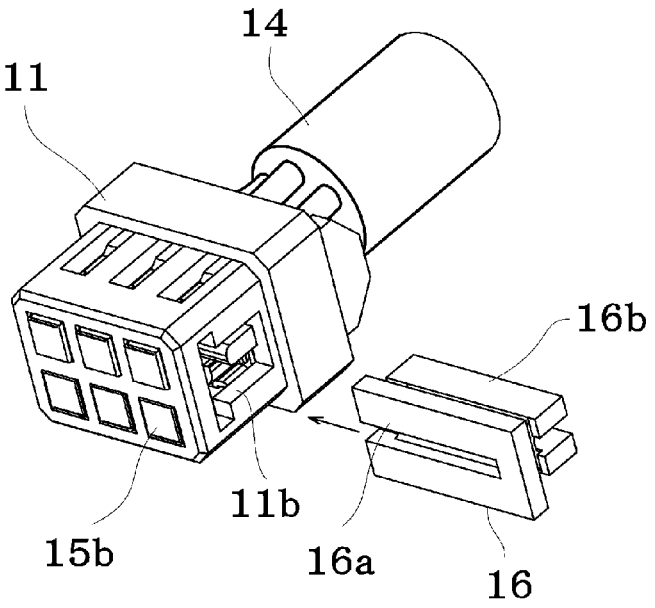
FIG. 5A illustrates a state in which a retainer is inserted from a side portion of the housing.
FIG. 5B illustrates a state in which the side portion of the terminal, the interior of the housing, and the end portion of the cable are embedded by a hot-melt molding product.
Figure 5:
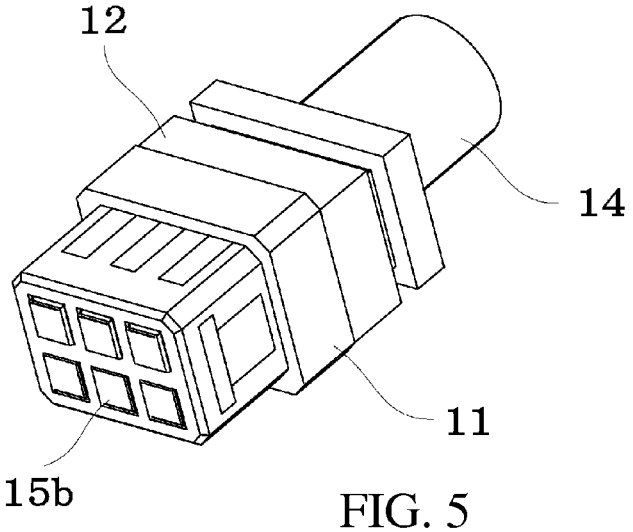

As illustrated in FIG. 5, the retainer 16 has a support surface 16*a* of the terminal 15, and an engagement portion 16*b* engaging the retainer with the housing 11, and is inserted from the side portion of the housing 11.

The interior of the housing 11 has ribs 11*c* and 11*d* as illustrated in FIG. 7, and the engagement portion 16*b* of the retainer 16 is engaged with the ribs.

Next, as illustrated in FIG. 5B, the interior of the housing 11, the crimping portion 15*a* of the terminal 15, and a portion from the cable single line 14*a* to the covering end portion 14*c* of the cable 14 are embedded into the hot-melt molding body 12 molded by injecting the hot-melt resin (12*a* to 12*c*).

Figure 6:
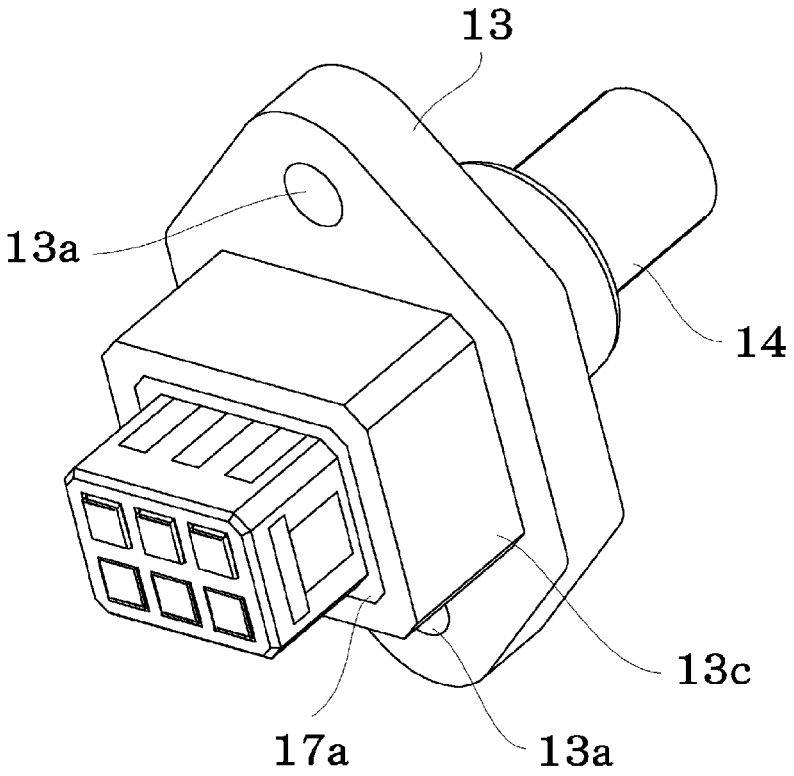
FIG. 6 illustrates a state in which a cord bushing is molded by insert molding.

Next, the cord bushing 13 is molded by the insert molding so as to enclose the hot-melt molding body 12 from the rear portion of the connector housing 11 as illustrated in FIG. 6.

In addition, an example illustrated in FIG. 6 illustrates an example of providing a seal member 17*a* between the cord bushing and the housing 11.

The cord bushing 13 has a loading portion 13*c* charged to the mounting hole 21*c* of the housing 21, and a flange portion 13*b*, and the flange portion 13*b* has a mounting hole 13*a*.

A cross-sectional structure thereof is illustrated in FIG. 7.

Figure 3:
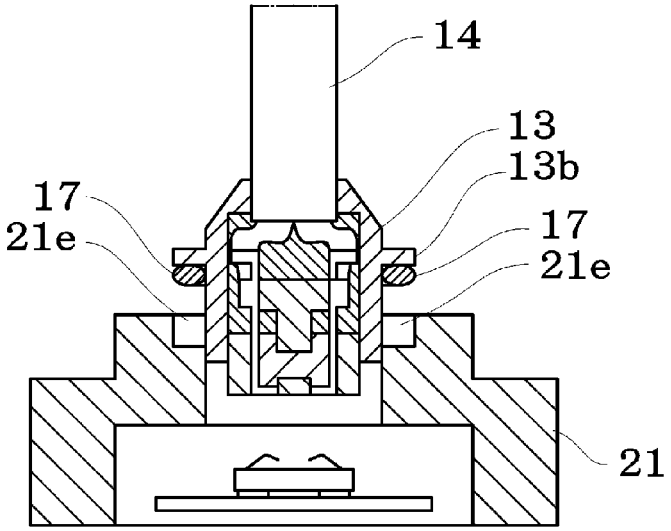
FIG. 3A illustrates a state before the connection of an example of another connection structure.
FIG. 3B illustrates a state after the connection thereof.
Figure 3:
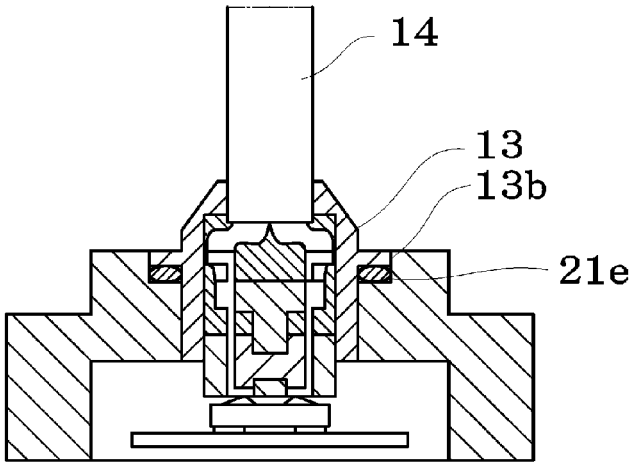

As a method for connecting and fixing the cable connector 10 and the housing 21, as illustrated in FIGS. 1 and 2, a fixing member 18 such as a screw may be screwed into a female screw portion (fixing hole) 21*d* of the housing 21 so as to interpose the seal member 17*a* between the flange portion 13*b* and the housing 21 via the mounting hole 13*a* provided in the flange portion 13*b*. Furthermore, as illustrated in FIG. 3, a method may be provided which fits the flange portion 13*b* to a fitting hole 21*e* so as to interpose the seal member 17*a* by providing the fitting hole in the housing 21.

What is claimed is:

1. An electrical connection structure between a module device and an external device comprising:

a module housing accommodating the module device having a mounting hole for mounting a cable connector electrically connected with the external device; and a contact of the module device disposed inside the module housing positioned in the mounting hole, wherein, the electrical connection structure includes a terminal configured to connect to the contact of the module device, and a connector housing that accommodates and holds the terminal, wherein, the terminal is held in the connector housing so as to have airtight and watertight properties from a connection portion between the terminal and a core wire of a cable to a covering portion of the cable, wherein the connection portion and the connector housing are connected so as to have the watertight property, wherein, a sealant is connected to the cable using a cord bushing, and wherein, the cord bushing and the housing are fixedly connected with a fixing member via a seal member.

2. The electrical connection structure between the module device and the external device according to claim 1, wherein, the terminal is accommodated in the connector housing in a state in which the core wire of the cable is connected to a rear portion of the terminal, and wherein, portion from the connection portion between the terminal and the core wire of the cable to the covering portion of the cable is embedded in a sealant.

3. The electrical connection structure between the module device and the external device according to claim 2, wherein, a retainer for supporting the terminal from the rear side is disposed in the connector housing and in a state of accommodating the terminal.

4. The electrical connection structure between the module device and the external device according to claim 1, wherein, a retainer for supporting the terminal from the rear side is disposed in the connector housing and in a state of accommodating the terminal.

* * * * *